United States Patent [19]

Speich

[11] Patent Number: 4,669,510

[45] Date of Patent: Jun. 2, 1987

[54] PROCESS FOR OPERATION OF A WEAVING MACHINE AS WELL AS APPLICATION OF THE PROCESS

[75] Inventor: Francisco Speich, Gipf-Oberfrick, Switzerland

[73] Assignee: Textilma AG, Switzerland

[21] Appl. No.: 740,050

[22] PCT Filed: Oct. 1, 1984

[86] PCT No.: PCT/CH84/00160

§ 371 Date: May 23, 1985

§ 102(e) Date: May 23, 1985

[87] PCT Pub. No.: WO85/01755

PCT Pub. Date: Apr. 25, 1985

[30] Foreign Application Priority Data

Oct. 7, 1983 [CH] Switzerland ..... 5478/83

[51] Int. Cl.[4] ..... D03D 51/08

[52] U.S. Cl. ..... 139/1 E; 139/1 R; 139/336; 139/370.1

[58] Field of Search ..... 139/1 E, 1 R, 336, 370.1, 139/370.2

[56] References Cited

FOREIGN PATENT DOCUMENTS

| | | | |
|---|---|---|---|
| 652826 | 12/1964 | Belgium . | |
| 0083676 | 7/1983 | European Pat. Off. . | |
| 0094089 | 11/1983 | European Pat. Off. . | |
| 0116292 | 8/1984 | European Pat. Off. . | |
| 2545903 | 4/1976 | Fed. Rep. of Germany | 139/1 E |
| 2514248 | 9/1976 | Fed. Rep. of Germany . | |
| 3129238 | 8/1982 | Fed. Rep. of Germany . | |
| 3134184 | 10/1983 | Fed. Rep. of Germany . | |
| 2009542 | 2/1970 | France . | |
| 2300834 | 9/1976 | France . | |
| 2496718 | 6/1982 | France . | |
| 2086439 | 5/1982 | United Kingdom | 139/1 E |
| 433257 | 12/1974 | U.S.S.R. | 139/1 E |

*Primary Examiner*—James Kee Chi

*Attorney, Agent, or Firm*—Toren, McGeady and Goldberg

[57] ABSTRACT

A weaving machine having a filling breakage detector for generating an error signal upon breakage of a filling thread. This error signal then stops the weaving machine. A pick finding process is then initiated in which the weaving program is set back and then blocked. After removal of any filling thread in the open shed, the weaving machine is operated until the preceding shed is opened enabling the removal of the filling thread. If this is the ruptured filling thread, it is replaced by a new filling thread, the weaving program is unblocked and the weaving machine is operated in its normal sequence. If the filling thread is not ruptured once or if another ruptured filling thread is detected in a preceding shed, the pick finding process is repeated. The cloth takeoff and the warp letoff are also set back correspondingly with the weaving program.

14 Claims, 17 Drawing Figures

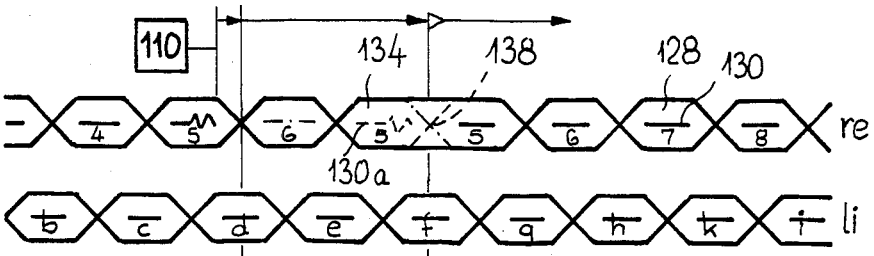
Fig. 7a
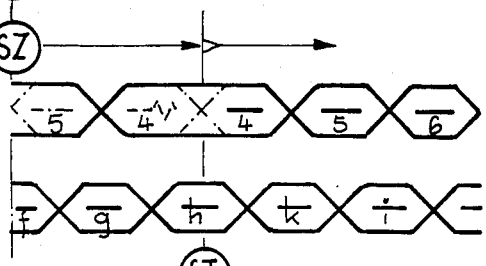
Fig. 7b
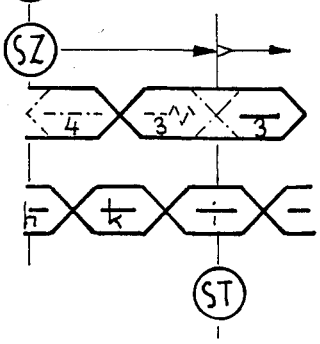
Fig. 7c
Fig. 7d
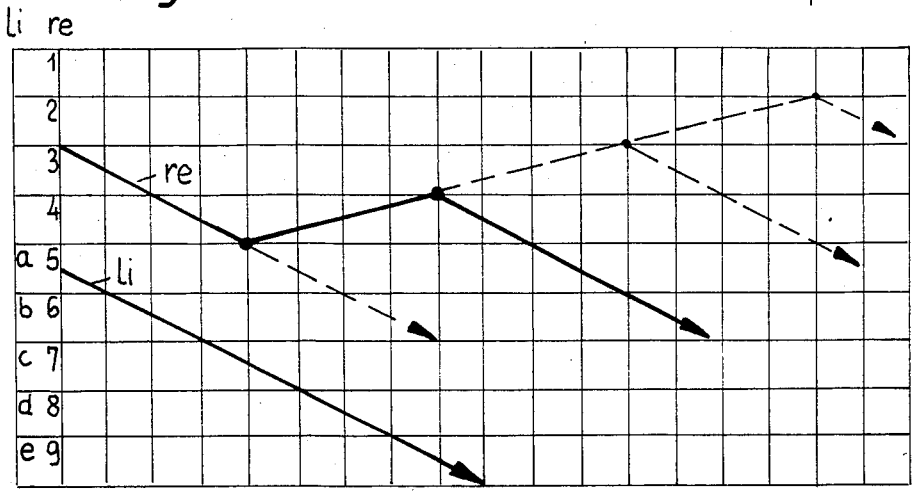

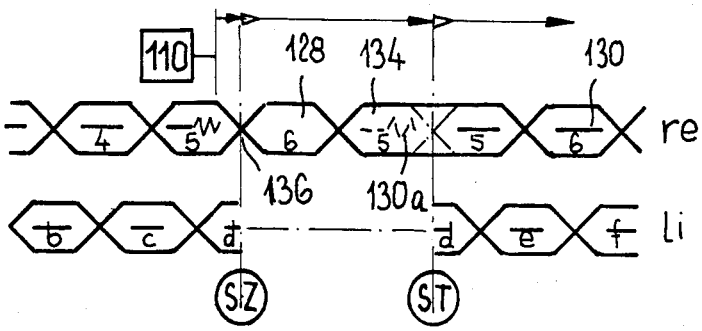
Fig.8a
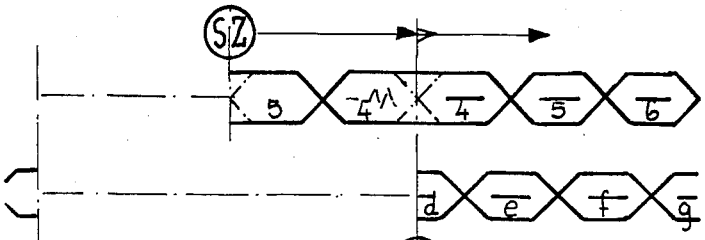
Fig.8b
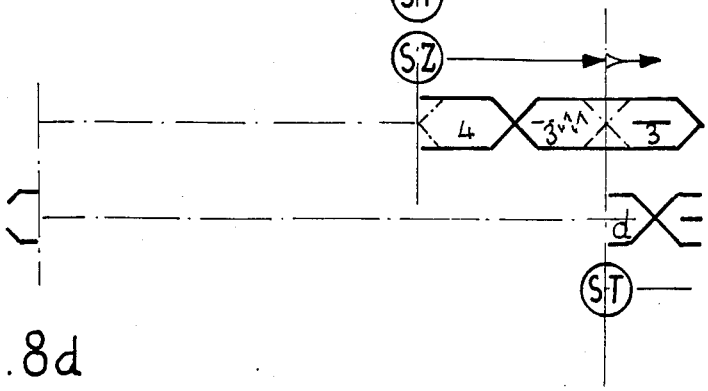
Fig.8c
Fig.8d
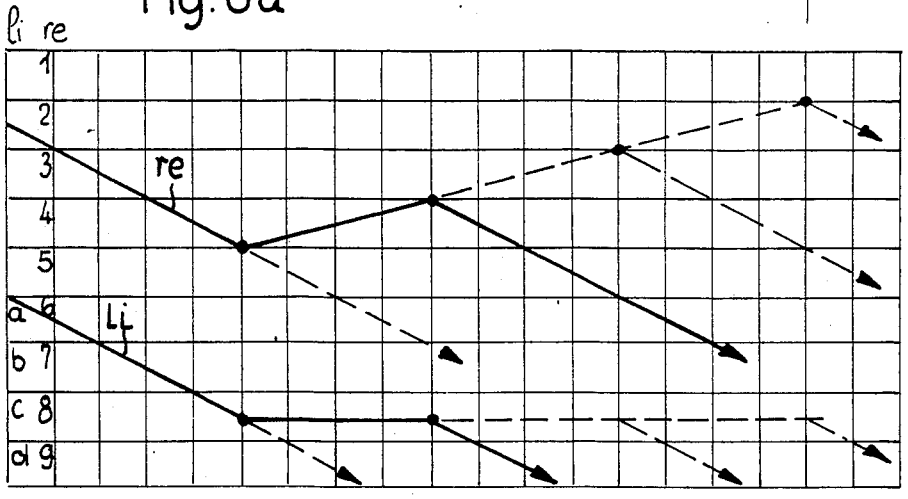

PROCESS FOR OPERATION OF A WEAVING MACHINE AS WELL AS APPLICATION OF THE PROCESS

BACKGROUND OF THE INVENTION

1. Field of the Invention:

The invention is directed to a process and apparatus for controlling a weaving machine which is stopped by an error signal of a filling breakage detector, wherein for pick finding, the weaving program of a control device of a shedding apparatus is set back and the pick finding occurs with the weaving machine running forward, and at least the cloth takeup being correspondingly set back.

2. Description of Related Art:

Processes of the above-named type are known, for instance, from the DE-OS No. 25 14 248. The process described there has, however, the disadvantage that the weaving machine apart from the stop, which is caused by an error signal of a filling stop motion, must perform two additional stops during a pick finding cycle, before the normal weaving process can be resumed. For the pick finding, furthermore, only one normal shed is available, so that tight limits are set to the stopping and the restarting of the weaving machine. Thus, the known process is cumbersome and time-consuming.

SUMMARY OF THE INVENTION

It is an object of the invention to create a process for control of a weaving machine which does not exhibit the above-mentioned disadvantages. Furthermore, also a double dobby weaving machine must is operable according to this process.

The above object is achieved in a process for controlling a weaving machine wherein, in each pick finding cycle, after being set back, the step-by-step action of the weaving program in each pick finding cycle is blocked at least for that shed, which follows the shed in which the ruptured filling thread is being searched for, in such a way that the shed to be examined remains open, at least as a double shed, during at least two filling cycles, whereupon the continuation of the sequentially correct next normal weaving process is triggered or, prior thereto, the pick finding cycle is repeated for respective preceding sheds accompanied by corresponding set backs of the weaving program, until the ruptured filling thread is found.

By designing the shed which has to be examined for the filling cycle as a double shed there results the advantage that considerable latitude is given with respect to stopping the weaving machine. On the other hand it is possible to immediately restart from this position of the weaving machine wich serves for the purpose of pick finging, without that the weaving machine would have to be first of all brought into a starting position. Thus the process is rendered to be more simple, more rapid and thus more economical.

It is particularly advantageous if the weaving machine stops in the first shed crossing following an error signal of the filling breakage detector. This makes possible, in particular in the case of double dobby weaving machines, the synchronization of the two weaving machine units. For a single weaving machine this stoppage may occur between the first and second shed crossing following the filling thread rupture, because there are no such high requirements with respect to accuracy in case of stoppage.

Particularly advantageous is also a refinement of the process in which at least a fabric takeoff and possibly the warp letoff is set back by a magnitude G, whereby $G=K\cdot L$, in which: L is the cloth length between two filling insertions and k Correction factor, wherein K=0.1 to 4, since then, possible errors of the cloth layer can be avoided. The correction factor can be freely chosen and depends, as a rule, on the properties of the cloth to be fabricated. The correction factor is therefore adjusted only once for the production of a specific cloth.

After the first stoppage of the weaving machine caused by the filling stop motion, the process can appropriately be triggered manually. It is, however, also imaginable to trigger the pick finding cycle directly by the error signal of the filling breakage detector.

The process can utilized for weaving machines of any type. Particularly advantageous is the use in a double dobby weaving machine. Accordingly, the weaving machine unit which is not experiencing the filling thread rupture can be decoupled during pick finding. It is, however, also possible to decouple the weaving machine unit not experiencing the filling thread rupture. The shedding apparatus of the weaving machine units can run synchronously or be displaced phasewise by 180°.

Embodiment examples of the invention are described in the following with particularity with the help of drawings, wherein it is shown in:

BRIEF DESCRIPTION OF THE DRAWINGS:

FIGS. 6*a* to 6*d* a shed diagram (FIGS. 6*a* to 6*c*) and a cloth diagram (FIG. 6*d*) in various phases of the pick finding in a simple weaving machine;

FIGS. 7*a* to 7*d* of shed diagram (FIGS. 7*a* to 7*c*) and a cloth diagram (FIG. 6*d*) in various phases of the pick finding in a double dobby weaving machine with simultaneous running of both weaving machine units; and FIGS. 8*a* to 8*d* a shed diagram (FIGS. 8*a* to 8*c*) and a cloth diagram (FIG. 8*d*) in various phases of the pick finding in a double dobby weaving machine, whereby the weaving machine unit not experiencing a filling thread rupture is decoupled.

DESCRIPTION OF THE PREFERRED EMBODIMENT

Figure 1:
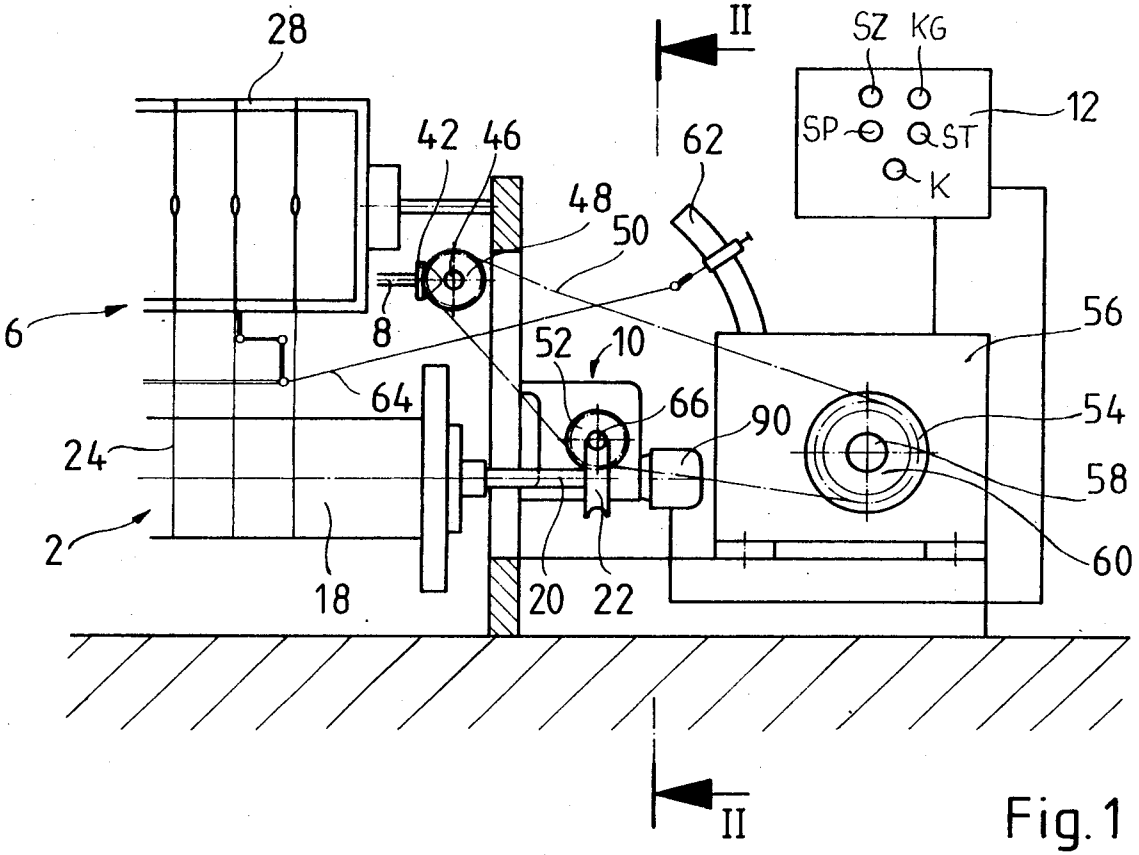
FIG. 1 a simple weaving machine in cutout and in elevation of the warp letoff apparatus.
Figure 2:
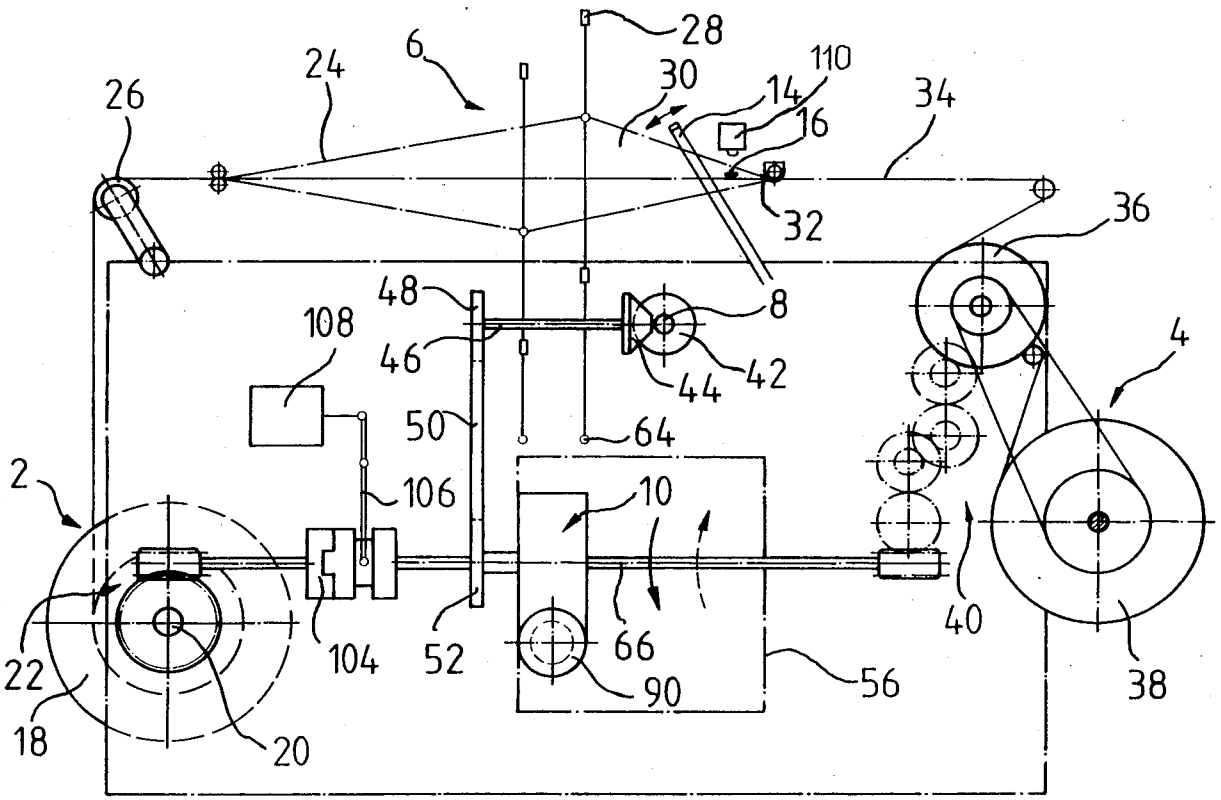
FIG. 2 the weaving machine of FIG. 1 in section II–II of the FIG. 1.
Figure 3:
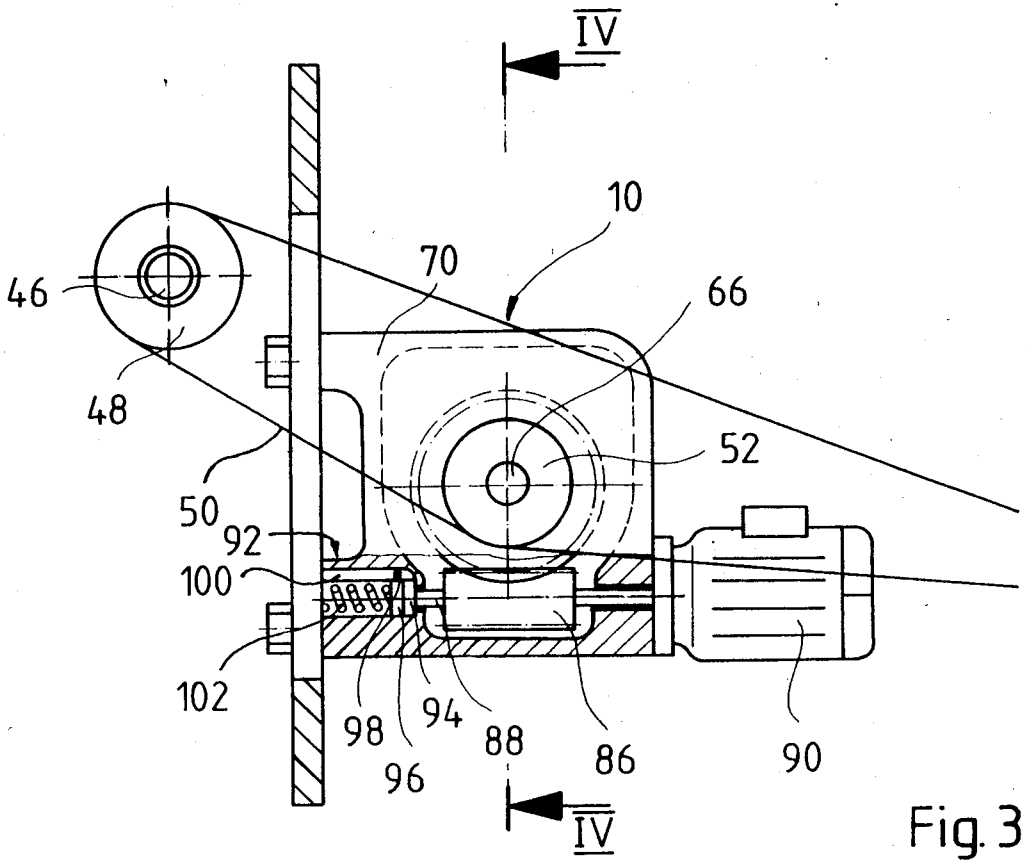
FIG. 3 the reversing gear unit in side view.
Figure 4:
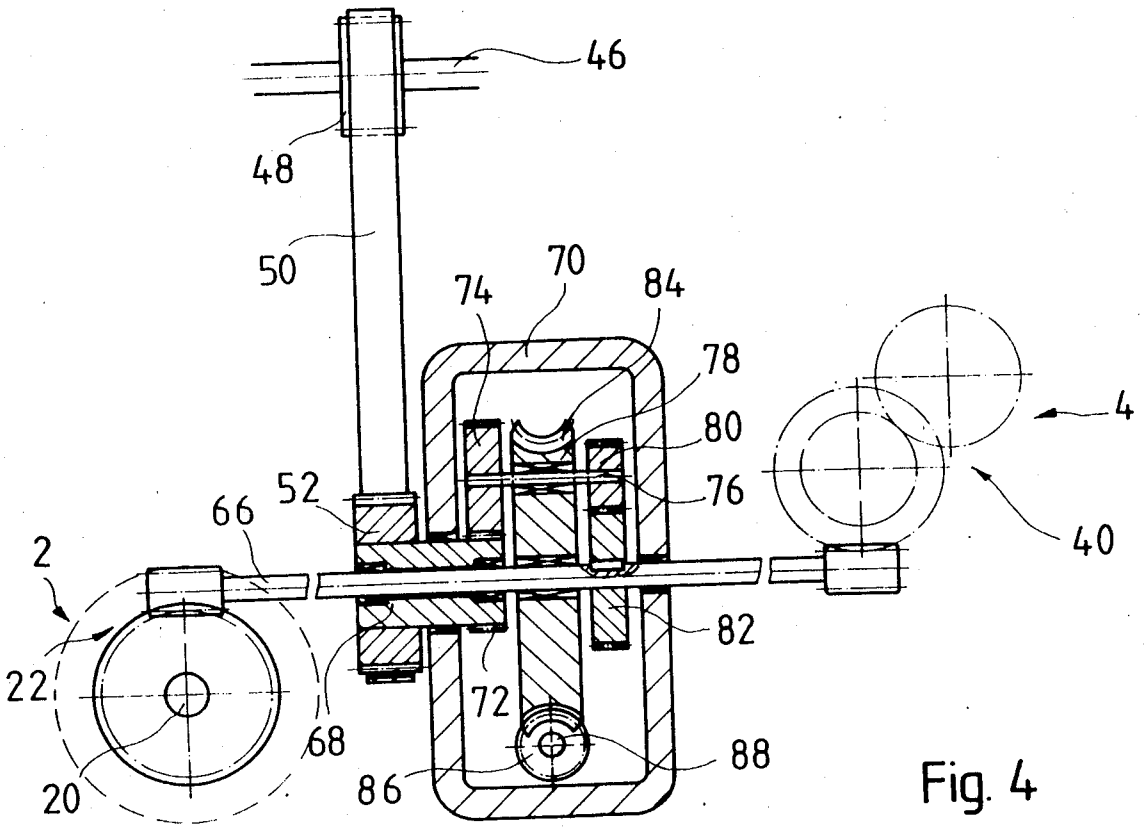
FIG. 4 the reversing gear unit in section IV–IV of the FIG. 3.

FIGS. 1 to 4 show a first embodiment of a weaving machine comprising a warp letoff apparatus 2, a fabric takeoff apparatus 4, a shedding apparatus 6, a principal drive 8 with a drive motor not shown in detail here, a reversing gear unit 10 connected with the warp letoff apparatus 2 and the fabric takeoff apparatus 4, as well as an electonic control device 12 for a weaving program. Connected at the principal drive 8 in a manner, for example, known from the U.S. Pat. No. 4,305,434 which is not shown here in detail, are a weaving reed 14 and a filling thread inserting element 16.

The warp letoff apparatus 2 contains a warp beam 18, whose shaft is driven by a worm gear 22. From the warp beam 18, the warp threads 24 pass over a back rest 26 to the shafts 28 of the shedding apparatus 6, which serve for creating and changing the warp shed 30. A filling thread inserting unit 16 periodically engages into the warp shed 30. The inserted filling thread is attached at the cloth edge 32 by means of the weaving reed 14. The weaved cloth 34 is tightened by the feed roller 36 and is pulled off and wound up on the cloth beam 38. The fabric takeoff apparatus 4 containing the feed roller 36 and the cloth beam 38 is driven by means of a regulator gear 40.

For driving the warp letoff apparatus 2, the fabric takeoff apparatus 4 and the shedding apparatus 6, an auxiliary drive shaft 46 is connected at the main drive 8 by means of bevel gears 42, 44. This auxiliary drive shaft 46 has a gear wheel 48, which drives, by means of a tooth belt 50, a drive wheel 52 for the warp letoff apparatus 2 and the fabric takeoff apparatus 4, as well as a drive wheel 54 for the shedding apparatus 6. The shedding apparatus 6 contains a dobby 56, whose drive shaft 58 is connected with the drive wheel 54, possibly with interposition of a clutch 60. The dobby 56 which, for instance, is constructed and controlled according to the U.S. Pat. Nos. 4,493,346 and 4,452,281, comprises shaft swing arms 62, which are respectively connected with the shaft 28 by means of a lever drive 64 and which enable to hold the shed open over at least two filling thread insertion processes.

The drive wheel 52, for driving the warp letoff apparatus 2 at the fabric takeoff apparatus 4, is connected with a drive shaft 66 by means of the reversing gear unit 10, designed as a superimposed gear, which shaft drives on the one hand the worm gear 22 of the warp gear, which drive shaft 66 drives, at one end, the worm gear 22 of the warp letoff apparatus 2 and, at the other end, the regulator gear 40 of the fabric takeoff apparatus 4. The drive wheel 52 is arranged in a bearing sleeve 68, which is supported on the drive shaft 66 so as to be freely rotatable with respect to the drive shaft 66. The bearing sleeve 68 protrudes into a housing 70 and carries a gear wheel 72 with which a planetary wheel 74 meshes. This planetary wheel 74 is arranged upon a shaft 76 so as to be non-rotatable with respect to shaft 76. The shaft 76 is supported in a satellite carrier 78 so as to be rotatable with respect to same, which carrier 78 upon its part is rotatably supported on the drive shaft 66. On the shaft 76, on the other side of the satellite carrier 78, another planetary wheel 80 is connected to be non-rotatable with respect to the shaft 76. The second planetary wheel 80 meshes with a gear wheel 82 arranged on the drive shaft 66 to be non-rotatable with respect to the drive shaft 66. The satellite carrier 78 is designed as a worm wheel and comprises, at its periphery, a set of worm gear teeth 84 which coacts with a worm wheel 86, a drive shaft 88 thereof being connected to an auxiliary motor 90. The worm drive formed out of the set of worm gear teeth 84 and the worm wheel 86 is preferably designed to be self-locking. The reverse gear unit 10 is furthermore provided with a braking device 92 to prevent coasting. The braking device 92 comprises a friction disk 94 arranged on the drive shaft 88 to be non rotatable with respect to the shaft 88, with which coacts friction disk 96 which is arranged in the housing 70 to be non-rotatable with respect to the housing 70. A lug 98 arranged on the friction disk 96 engages a groove 100 in the housing 70, which lies parallel to the drive shaft 88 and prevents twisting of the friction disk 96. A preloading spring 102 preloads the friction disk 96 against the friction disk 94 connected to the drive shaft 88.

Drive shaft 66 is interrupted by means of a clutch 104 at the portion running towards the warp letoff apparatus 2. This clutch 104 is, for example, designed as a claw clutch, which can be switched over by a switching lever 106 and an actuation device 108, so that the drive of the warp letoff apparatus 2 can be switched off if required.

The weaving machine is equipped with the electronic control device 12, which, on the one hand, is connected with the dobby 56 of the shedding apparatus 6 and, on the other hand, with the auxiliary motor 90 of the reversing gear unit 10. At the control device 12 there are connected also warp breakage detectors, as the filling breakage detector 110. Furthermore, the control device 12 has a set of pushbuttons for triggering of various functions:

ST: Normal start
SP: Normal stop
SZ: Preparation of the pick finding cycle
KG: Normal creep speed forward
K: Correction factor triggering
The correction factor is recorded by means of a coding switch previously and applicable to a specific class and is triggered by means of the pushbutton K. The correction factor K can be freely triggered as for instance after: normal or longer stoppage of the weaving machine; warp thread ruptures; pick finding.

The electronic control device 12 which is suitably equipped with a processor, enables switching the weaving program backwards with the weaving machine running forward, so that the dobby 56, which is indeed driven in the forward direction, performs a reverse motion sequence. Simultaneously, the control device 12 controls the auxiliary motor 90 of the reversing gear unit 10, so that, for the purpose of pick finding after a filling thread ruptures, the warp letoff apparatus 2 and the fabric takeoff apparatus 4 can be switched into reverse, as is explained, with the help of FIGS. 6*a* to 6*d* in some detail in the description following further below.

Figure 5:
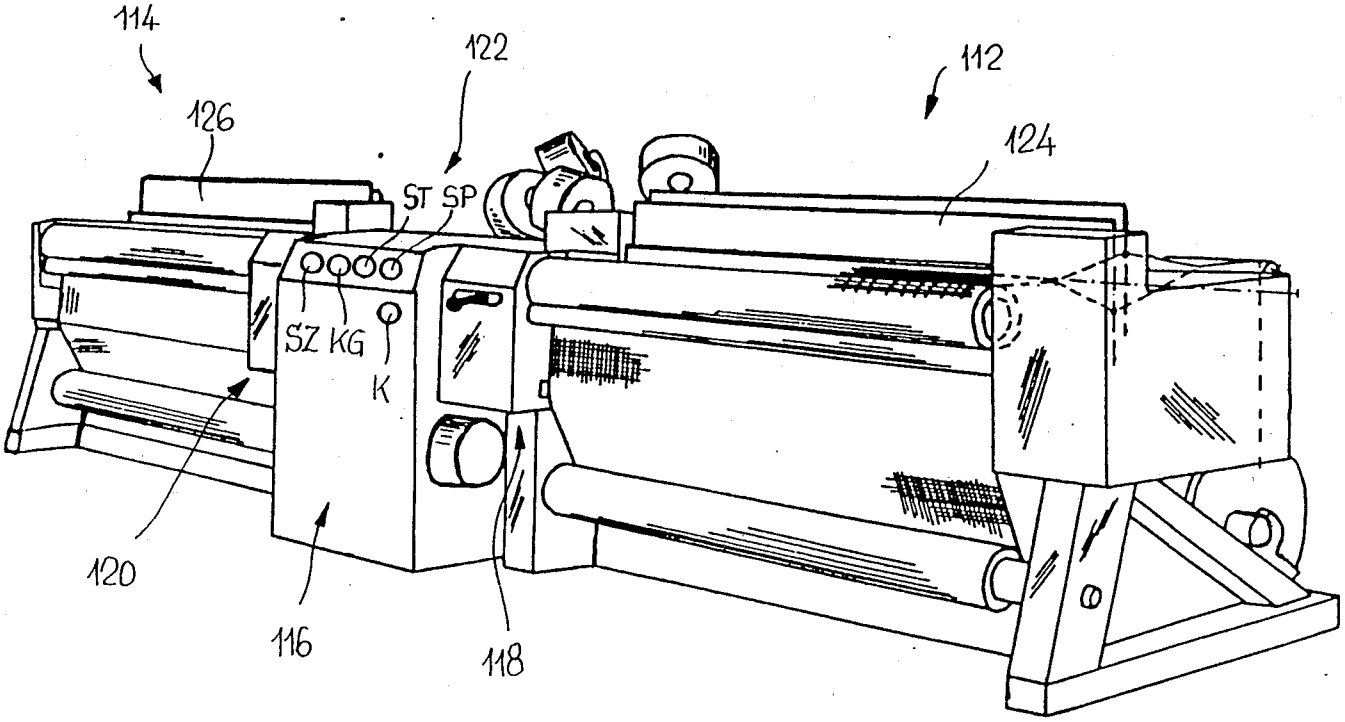
FIG. 5 a double dobby weaving machine in picture presentation.

FIG. 5 shows a double dobby weaving machine in perspective, in which two weaving machine units 112, 114, arranged one next to the other are connected to a common drive device 116. Each weaving machine unit 112, 114 contains its own shedding apparatus 118, 120 which are also connected to the common driving device 116. Furthermore, the double dobby weaving machine contains a control device 122 with applicable pushbuttons ST, SP, SZ, KG and K, whose function has been explained in connection with FIG. 1.

The double dobby weaving machine, which as a matter of fact is explained in detail in the U.S. Pat. No. 4,448,220, is equipped as a two-phase gripper weaving machine. The shedding apparatus 118, 120 actuates the respective shaft 124, 126 of the individual shedding apparatus 118, 120 of the weaving machine units 112, 114 in a phasewise staggered manner and through an angle of 180°. The control of the double dobby weaving machine is described with particularity in the FIGS. 7*a* to 7*d* as well as 8*a* to 8*d*.

Figure 6A:
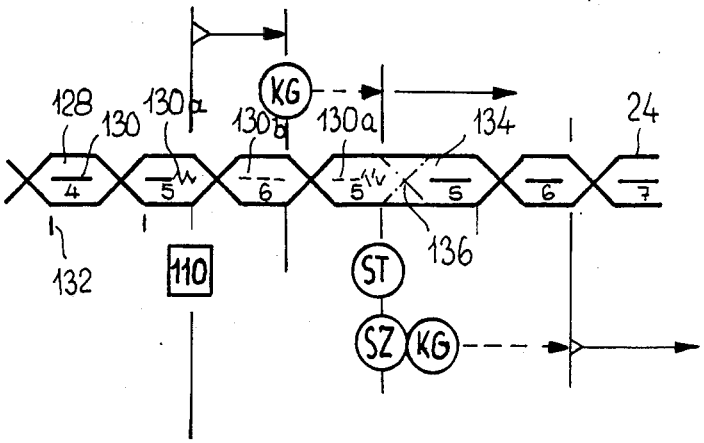
Figure 6D:
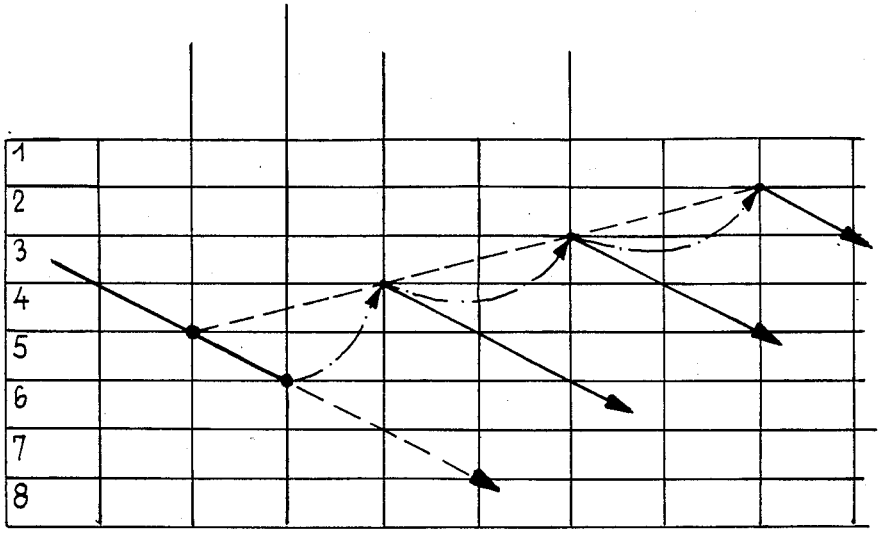

The FIGS. 6*a*, 6*b* and 6*c* show shed diagrams for a weaving machine of the FIGS. 1 to 4 in a first pick finding cycle as well as in second and third pick finding cycles. FIG. 6*d* show the cloth diagram pertaining to the above shed diagrams. The individual sheds 128 formed by the warp threads 24 carry, respectively, the applicable weaving program stage numbers 3 to 7. In the individual sheds 128, the filling threads 130 are inserted. At the timing spot 132, the cycle pulse for the next shed but one is taken off.

The pick finding occurs as follows:

As can be gathered from FIG. 6*a*, the filling breakage detector 110 in the shed 128 detects at the weaving program stage number 5, a ruptured filling thread 130*a*. Thereupon, a stop impulse is triggered and the weaving machine is stopped at the end of the following shed 128 having the weaving program stage number 5+1=6. Simultaneously, the weaving program of the control device 12 is switched back by one weaving program stage and a counter therein is blocked, which responds to the timing spot 132. A filling thread 130*b*, possibly located within this shed, can be removed. Now the pushbutton KG is actuated and the weaving machine continues to run at creeping speed until the next preceding shed 128 having the setback weaving program stage number 5 is opened. Since the counter for the timing spot 132 is blocked, the weaving program cannot be switched further, so that the weaving program stage number 5 applies for the shed to be closed. This means that the shed does not yet close at the first pick finding process but rather only after the second pick finding process. The weaving machine stops now in the first half of the thus formed double shed 134 with the weaving program stage number 5. A possibly ruptured filling thread 130*a* can now be removed. If the filling thread rupture is eliminated by this, then the weaving machine can, by means of pressing the pushbutton ST, be put back into operation in order to continue the normal weaving process and the normal sequentially correct weaving program stage numbers 6, 7, etc. follow. The first filling thread 130 is already inserted into the second half of the double shed 134. During this first pick finding cycle, the fabric takeoff and the warp letoff are put back by one filling stage, as can be gathered from the cloth diagram in FIG. 6*d*.

If one detects at the double shed 134 having the weaving program stage number 5, that an additional further ruptured filling thread must be searched for, then the pushbutton SZ must be actuated which prepares the further pick finding cycle, in that the weaving program at the control device is again put back by one weaving program stage and the timing counter is blocked. By a further operation of the pushbutton KG, the weaving machine is switched into creeping speed and operates until a preceding shed having the weaving program stage number 4 is opened. Simultaneously the fabric takeoff and warp letoff are put back by one filling cycle. If one now ascertains that the pick finding is now finished, then the normal weaving progress can again be triggered by operating the starting button ST, whereby already again a filling thread 130 is inserted into the second half of the double shed 134 with the weaving program stage number 4.

The weaving process progresses now again normally. If, however, one detects in the first half of the double shed 134 that another ruptured filling thread is to be searched for, then an additional pick finding cycle of the nature described above occurs.

The FIGS. 7*a* to 7*d* show a first, second and third pick finding cycle for a double dobby weaving machine of the type shown in FIG. 5, wherein the upper shed diagram pertains to the righthand weaving machine unit 112 and the lower shed diagram pertains to the lefthand weaving machine unit 114. If the filling breakage detector of the righthand weaving machine unit 112 detects a filling thread rupture in the shed 128 with the weaving program stage number 5, then the double dobby weaving machine stops at the following thereupon shed crossing point 136. By operating the pushbutton SZ, the first pick finding cycle is triggered. This entails that the weaving program in the control device is set back by one weaving program stage and that the timing counter is temporarily blocked. The regulator for the fabric takeoff and the weaving machine unit in which the filling thread rupture has been detected is set back. The entire double dobby weaving machine is futhermore switched forward in creeping speed, and indeed by two filling stages or one revolution of the shaft of the shedding apparatus. By means of the setting back of the weaving program stage and the blocking of the timing counter again a double shed 134 with the weaving program stage number 5 is generated. The double dobby weaving machine now stops in the false crossing point 138 of the double shed 134. Ruptured filling thread 130*a* are removed. If one ascertains that no additional ruptured filling thread exists, then the double dobby weaving machine can again be switched on by actuation of the starting button ST and can be put into the normal weaving process, whereby a first filling thread 130 is already inserted into the second half of the double shed 134.

If however an additional ruptured filling thread is detected, then again the pushbutton SZ is actuated whereupon a second pick finding cycle according to FIG. 7*b* is triggered. The double dobby weaving machine now stops again in a double shed 134 with the next lower weaving program stage number 4. A ruptured thread 130*a* is removed. Should no additional ruptured filling threads be detectable, then the double dobby weaving machine can be again restarted by actuation of a pushbutton ST and the normal weaving process can again be triggered. Into the second half of the double shed 134 already a first filling thread 130 is being inserted.

With this design of the control device and a double dobby weaving machine, there results the advantage that the double dobby weaving machine is constructed in a very simple manner since no pick finding gear is required. This results in a good accessibility of the shedding apparatus. Only a pushbutton actuation is required for triggering of the pick finding cycle.

For the cloth reversing motion, the regulator is equipped with a regulator clutch in order to couple the regulator into reverse. In the FIGS. 8*a* to 8*c*, the shed diagrams of a double dobby weaving machine are shown, in which, during removal of a filling thread rupture in one weaving machine unit, the other weaving machine unit is decoupled until the pick finding is terminated. Hereby the pick finding occurs similarly to the embodiment example of the FIGS. 7*a* to 7*c*. Inasmuch as in the double dobby weaving machine, in case of occurrence of a filling thread rupture and an indication by the filling stop motion breakage detector, the weaving machine unit concerned is brought to a stop in the next shed crossing point 136, the accurate decoupling of the other weaving machine unit is assured. Since also during pick finding the weaving machine unit comes to a stop in the false crossing point 138 of the double shed 134, exactly the same conditions result as during decoupling of the other weaving machine unit, so that the reengagement can again occur in a synchronous manner, as this can be gathered from the shed diagrams of the FIGS. 8*a* to 8*c* as well as from the cloth diagram 8*d*. The advantage of this solution variant consists in that the double dobby weaving machine is at a standstill and the shed is being moved only at the rupture side. Thus there is no danger of damage at the shedding apparatus. For a pick finding cycle also only one pushbutton actuation is required.

List of Reference Numbers

ST: Normal start
SP: Normal stop
SZ: Preparation for the pick finding cycle
KG: Normal creep speed forward
K: Correction factor-triggering

2: Warp letoff apparatus
4: Fabric takeoff apparatus
6: Shedding apparatus
8: Main drive
10: Reversing gear unit
12: Electronic control device
14: Weaving reed
16: Filling insertion unit
18: Warp beam
20: Shaft of 18
22: Worm gear
24: Warp threads
26: Back rest
28: Shaft
30: Warp shed
32: Cloth edge
34: Cloth
36: Feed roller
38: Cloth beam
40: Regulator gear
42: Bevel gear
44: Bevel gear
46: Auxiliary drive shaft
48: Gear wheel
50: Cog belt
52: Drive wheel for 2
54: Drive wheel for 6
56: Dobby
58: Drive shaft
60: Clutch
62: Shaft swing arm
64: Lever drive
66: Drive shaft
68: Bearing sleeve
70: Housing
72: Gear wheel
74: Planetary wheel
76: Shaft
78: Satellite carrier
80: Planetary wheel
82: Gear wheel
84: Worm gear tooth system
86: Worm gear
88: Drive shaft
90: Auxiliary motor
92: Braking device
94: Friction disk
96: Friction disk
98: Lug
100: Nut
102: Preloading spring
104: Clutch
106: Clutch lever
108: Actuation device
110: Filling breakage detector
112: Weaving machine unit, right side
114: Weaving machine unit, left side
116: Driving device
118: Shedding apparatus
120: Shedding apparatus
122: Control device
124: Shaft
126: Shaft
128: Shed
130: Filling thread
130*a*: Ruptured filling thread
130*b*: Additional filling thread
132: Timing place
134: Double shed
136: Shed crossing point
138: False crossing point

I claim:

1. Process for controlling a weaving machine, which is stopped by an error of a filling breakage detector, wherein for pick finding, the weaving program of a control device of a shedding apparatus is set back and the pick finding occurs with the weaving machine running forward, and additionally at least the cloth takeup is correspondingly set back, chracterized in that, after being set back, the step-by-step action of the weaving program in each pick finding cycle is blocked at least for that shed, which follows the shed in which the ruptured filling thread is being searched for, in such a way that the shed to be examined reamains open, at least as a double shed, during at least two filling cycles, whereupon the continuation of the sequentially correct next normal weaving process is triggered or, prior thereto, the pick finding cycle is repeated, for respective preceding sheds accompanied by corresponding set backs of the weaving program, until the ruptured filling thread is found.

2. Process according to claim 1, characterized in that during the first pick finding cycle, the weaving program for the next shed, which finding cycle, the which the weaving machine stops, is set back to the weaving program stage number of the shed to be examined preferably by one weaving program stage number.

3. Process according to claim 2, characterized in that the weaving program, upon pick finding cycles following the first pick finding cycle, is respectively set back by respective additional weaving program stage numbers.

4. Process according to claim 1, characterized in that the weaving machine stoppage, caused by the filling breakage detector; occurs in the first shed crossing following the filling thread rupture.

5. Process according to claim 1, characterized in that the weaving machine stoppage, caused by the filling breakage detector, occurs between the first and the second shed crossing following the filling thread rupture.

6. Process according to claim 1, characterized in that, in each pick finding cycle, the weaving machine is stopped in the area of the double shed to be examined.

7. Process according to claim 1, characterized in that, in each pick finding cycle, the weaving machine is stopped in the false crossing of the double shed.

8. Process according to claim 1, characterized in that, for a pick finding cycle, the fabric takeoff and the warp letoff are set back by a magnitude G, whereby $$G=K\cdot L$$

in which:

L is the cloth length between the two filling insertions, and

K is a Correction factor, wherein K=0.1 to 4.

9. Process according to claim 1, characterized in that the pick finding cycle is triggered by means of a hand actuated switch.

10. Process according to claim 1, characterized in that the pick finding cycle is triggered by means of the filling breakage detector.

11. Application of the process according to claim 1 in a double dobby weaving machine, in which two weaving machine units arranged one next to the other comprise a common drive and two separate shedding apparatus.

12. Application according to claim 11, characterized in that the weaving machine unit not experiencing a filling thread rupture is allowed to continue to operate.

13. Application according to claim 11, characterized in that the weaving machine unit not experiencing the filling thread rupture is decoupled from the drive during the pick finding in the other weaving machine unit.

14. Application according to claim 11, characterized in that the shedding apparatus of the weaving machine units operate staggered phasewise by 180°.

* * * * *